US005431411A

United States Patent [19]

Padilla

[11] Patent Number: 5,431,411

[45] Date of Patent: Jul. 11, 1995

[54] COMBINATION PORTABLE SPORTS GOAL AND PITCH BACK ASSEMBLY

[76] Inventor: Ronald G. Padilla, 12029 W. Tanforan St., Morrison, Colo. 80465

[21] Appl. No.: 316,885

[22] Filed: Oct. 3, 1994

[51] Int. Cl.[6] ..... A63B 63/04

[52] U.S. Cl. ..... 273/400; 273/26 A; 273/398; 273/127 C; 273/411

[58] Field of Search ..... 273/26 A, 29 B, 181 F, 273/398, 400, 401, 410, 411, 127 B, 127 C

[56] References Cited

U.S. PATENT DOCUMENTS

| | | | |
|---|---|---|---|
| 2,923,547 | 2/1960 | Heeremans | 273/26 A |
| 3,836,144 | 9/1974 | Mahoney | 273/26 A |
| 4,083,561 | 4/1978 | Daffer, Jr. | 273/411 |
| 4,127,272 | 11/1978 | Pennell | 273/398 |
| 4,553,751 | 11/1985 | Ketchum | 273/26 A |
| 4,932,657 | 6/1990 | Hailer et al. | 273/26 A |
| 5,007,638 | 4/1991 | Yukl | 273/26 A |
| 5,118,103 | 6/1992 | Miller | 273/26 A |
| 5,186,469 | 2/1993 | Terris | 273/411 |
| 5,246,229 | 9/1993 | Carey | 273/127 C |
| 5,273,292 | 12/1993 | Pardi et al. | 273/400 |

FOREIGN PATENT DOCUMENTS

| | | | |
|---|---|---|---|
| 2636659 | 3/1990 | France | 273/127 B |

*Primary Examiner*—Mark S. Graham
*Attorney, Agent, or Firm*—Charles C. Corbin

[57] ABSTRACT

Disclosed is a portable sports goal and pitch back assembly of tubular construction including a U-shaped main, generally upright frame with a horizontal top bar and two side posts, and a foot member that extends rearwardly at a right angle from the lower end of each side post. There is also a ground-engaging U-shaped base frame that includes a rear cross member and a pair of laterally spaced side members with front ends that connect to the rear ends of the foot members by way of adjustable, releasably lockable hinge joints that are used to lock the main frame at a desired inclination. In one configuration of the assembly, the main frame is vertical, and a net is mounted about the peripheries of the frames, and the assembly serves as a sports goal. The assembly is adjustable to another configuration for use as a pitch back device, by substantially inclining the main frame, and mounting a tensioned rebound net across the face of the inclined frame. For transport and storage, the assembly is foldable to a compact configuration that offers a relatively narrow side profile, and it can support itself upright on a horizontal surface.

9 Claims, 2 Drawing Sheets

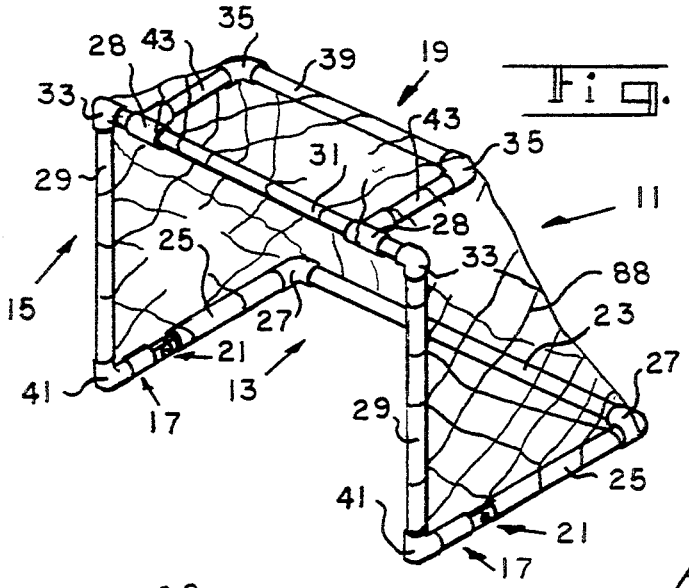
Fig. 1
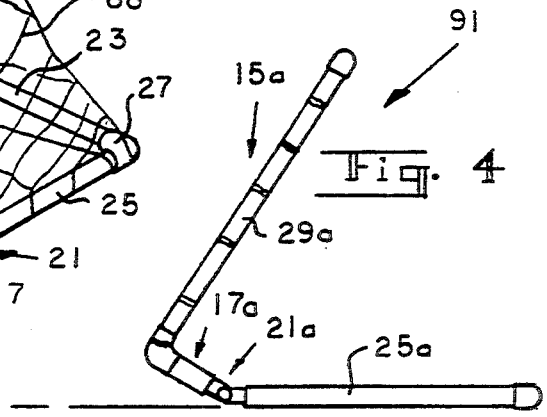
Fig. 4
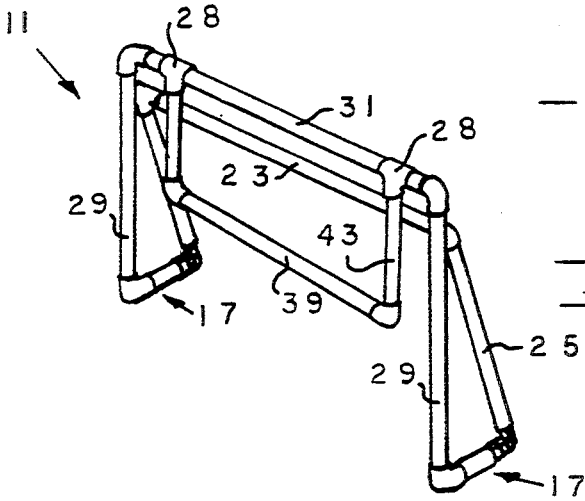
Fig. 2
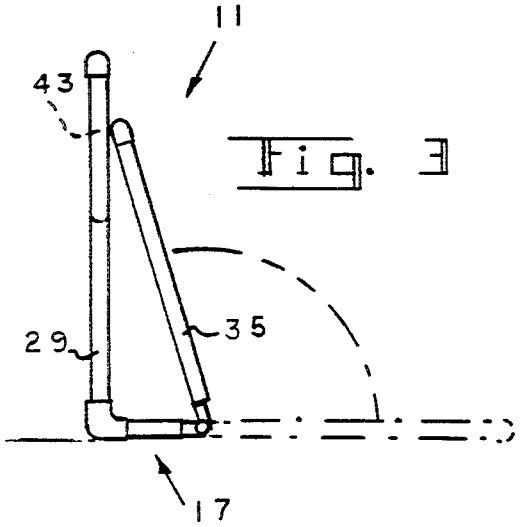
Fig. 3
Fig. 5
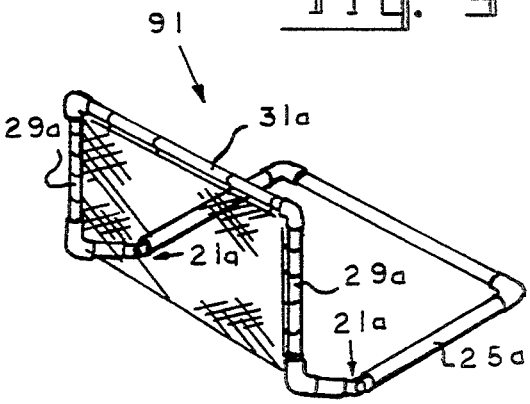

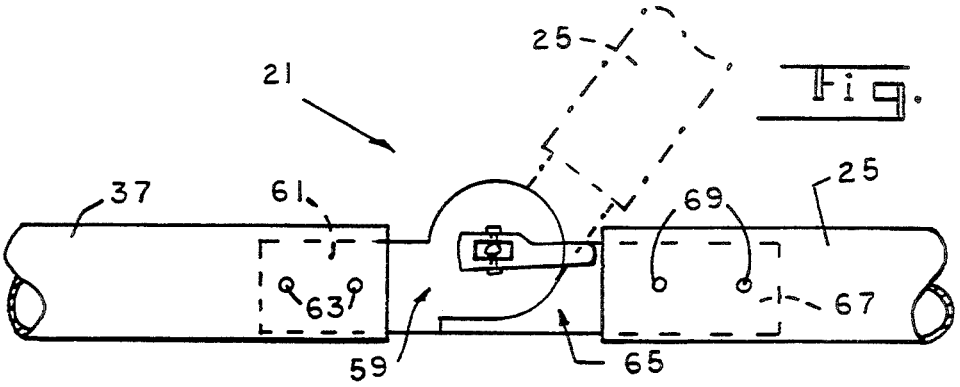
Fig. 6
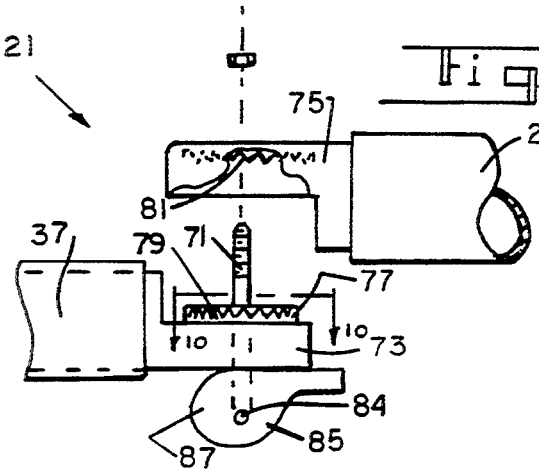
Fig. 7
Fig. 10
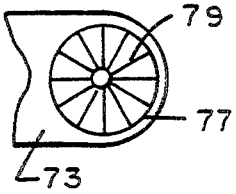
Fig. 8
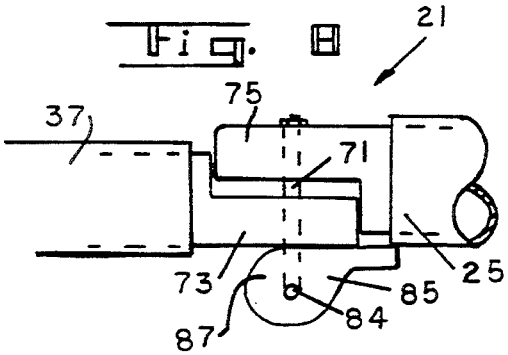
Fig. 9
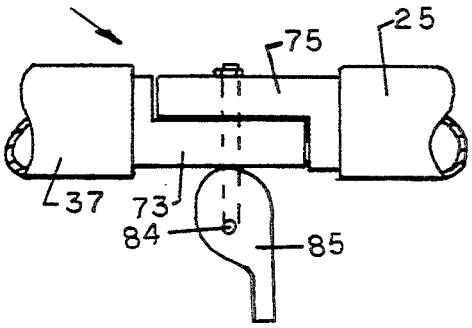

COMBINATION PORTABLE SPORTS GOAL AND PITCH BACK ASSEMBLY

BACKGROUND OF THE INVENTION

1. Field of the Invention

The present invention relates to a portable collapsible sports goal, and more particularly to a sports goal assembly that is foldable and usable as a device for rebounding balls.

2. Description of the Prior Art

Recreational sports of all varieties have enjoyed a tremendous growth in popularity in recent years. This is particularly true of recreational team sports that are played on indoor and outdoor fields, and which involve a ball or similar object that opposing teams endeavor to advance towards the opponents' goal, and strike into that goal. Such sports include soccer and ice and field hockey, as well as a number of lesser known yet emerging sports such as broom ball, street hockey and bicycle polo. Because of the popularity of sports such as soccer, for example, and the limited available field space, versions of the game have been developed for fewer players than the standard game calls for. In these cases a shortened field is used, there is no goal keeper, and the goal is relatively small. Goals that are smaller than standard size are also used in certain levels of youth soccer.

In view of the foregoing, there has arisen the need for portable sports goals, for soccer and other sports, that can be transported to a site, set up and then removed after play is over. The prior art shows a variety of portable sports goals, for example the devices shown in U.S. Pat. Nos. 5,308,083, 5,273,292, 5,080,375, 5,186,469, and 4,407,507. While these and other prior art examples have certain selling points, they are not without drawbacks and shortcomings. For example, some prior portable sports goals tend to be sturdy, yet too bulky and heavy for being carried by one person. Other devices have relatively sharp edges which can pose a hazard to players, and there are some that must be disassembled for transport and storage.

SUMMARY OF THE INVENTION

With the foregoing in mind, it is a general object of the present invention to provide an improved portable sports goal that is easy to transport and store.

A more specific object is to provide such a sports goal that is easily foldable to a stow configuration, and which does not have to be disassembled, and which can be quickly deployed to am operative configuration.

Another object is to provide a sports goal that is sufficiently light that one person can carry it in its folded configuration.

A further object is to provide a sports goal that, in its folded configuration, has a narrow side profile and can support itself in an upright position.

Yet another object is to provide such an assembly that has rounded, nonhazardous surfaces.

A still further object is to provide a sports goal assembly that easily converts to a pitch back device.

These, and other objects and advantages are provided by the present invention comprising a sports goal assembly that includes a tubular U-shaped generally upright main frame having a top horizontal bar and a pair of side posts, the side posts and top bar defining a rectangular goal mouth as well as a support frame for mounting a rebounding net, and the assembly further including a pair of foot members, one of each extending rearwardly at a right angle from the lower end of a side post. The assembly also includes a ground-engaging U-shaped base frame, having a rearward cross member and a pair of side members. A pair of adjustable and releasably lockable hinges connect the front ends of the base frame side members with rear ends of the foot members, and permit tilting of the main frame about transverse horizontal axes through the hinges, and locking of the main frame at a desired inclination to the vertical.

In one preferred embodiment there is a supplementary net support frame for holding horizontally the upper part of a goal net, and for giving depth to the upper part of a goal cavity. This supplementary frame is U-shaped with a cross bar and two side bars, the ends of the side bars being attached to the main frame top bar by connectors that embrace the top bar in a manner that allows the supplemental frame to be rotated by hand about the top bar against a residual frictional force, the frictional force however being sufficient to hold the supplemental frame in a position to which it is rotated.

The inventive assembly has a deployed sports goal position in which the main frame is vertical, and the foot members are horizontally disposed in a ground-engaging position. The supplemental frame is rotated to a horizontal, rearwardly extending position, and a goal net is attached about the frames of the assembly to complete the assembly.

For transport and storage the assembly can be easily folded to a compact configuration by rotating the the supplemental frame to a vertical downward position, and by rotating the base frame upwards through 90 degrees to a position in which the base frame cross bar lies adjacent the side posts of the main frame.

The assembly can also advantageously be used as a pitch back device when the main frame is rotated to, and locked in an inclined position, and a suitable rebound net mounted across the rectangular mouth that is provided by the main frame, and the lower edge of the frame mouth spaced above the ground.

A greater appreciation of the invention can now be obtained by resort to the detailed description, drawings, and claims which follow.

BRIEF DESCRIPTION OF THE DRAWINGS

FIG. 1 is a perspective view showing deployment of a preferred embodiment of a sports goal according to the present invention;

FIG. 2 is a perspective view of the assembly of FIG. 1 in a folded, compact configuration;

FIG. 3 is a side elevational view of folded assembly of FIG. 2;

FIG. 4 is a side elevational view of an embodiment of the invention in a configuration for use as a pitch back device;

FIG. 5 is a perspective view of the assembly of FIG. 4;

FIG. 6 is an enlarged partial side view of the lockable hinge used in the invention;

FIG. 7 is an enlarged top exploded view, with parts broken away for clarity, of the hinge of FIG. 6;

FIG. 8 is a top view of the hinge of FIG. 7 in unlocked condition;

FIG. 9 is a view as in FIG. 8, but showing locked condition; and

FIG. 10 is a partially sectional view taken along the line 10—10 of FIG. 7.

DETAILED DESCRIPTION OF THE INVENTION

Referring now to the drawings, FIG. 1 depicts one preferred embodiment of the invention in the form of an assembly 11, the main components of which include a ground-engaging base frame 13, a main frame 15, foot members 17, a supplemental net support frame 19, and releasably lockable hinges 21.

Frames 13, 15 and 19, and members 17 are constructed of tubing and fittings of a suitable high strength plastic material such as polyvinylchloride (PVC), which will be seen to provide an assembly that is easy to fabricate, lightweight and strong, and without sharp surfaces.

The base frame 13 includes a rear bar 23 and side bars 25 which are secured rigidly in the U-shaped configuration shown, by two friction-fitting right angle elbow fittings 27, the use of a suitable adhesive being optional for greater permanency.

The main frame 15 is constructed similarily by affixing the posts 29 to opposite ends of a top bar 31 by way of a pair of right angle elbows 33. In this regard it should be noted that T-connectors 28 of the supplemental frame 19, to be described below, must of necessity be mounted to the bar 31 before both of the elbows 33 are secured thereto.

The foot members 17 extend rearwardly from posts 29 for a relatively short distance (compared to bars 25), and include tubular sections 37 that are affixed to posts 29 by way of right angle elbows 41. It will be seen that, among other things, these foot members 17 will serve as footings to allow the folded assembly, to be described below, to stand in a self-supporting upright storage position on a horizontal surface. The hinges 21 connect the base frame 13 to the rear ends of the foot sections 37, and will be described in some detail below.

The supplemental net support frame 19 has a cross bar 39 affixed to two side members 43 by way of a pair of right angle elbows 35, and in turn, the front ends of members 43 are affixed within the central sockets of the T-connectors 29. Each T-connector 28 provides an internal cylindrical surface, (not shown), that snuggly embraces the top bar 31 with a frictional fit, however the fit is not too tight to prevent rotation of connectors 28, and thus the frame 19, when a person applies a reasonable amount of force to rotate it about the bar 31 to a desired orientation. The residual frictional force is sufficient to hold the frame 19 in a horizontally deployed position for supporting a goal net as illustrated in FIG. 1, and in a vertical position for storage, in a manner to be described below.

FIGS. 6–10 illustrate the hinge 21 which comprises a first piece 59 having a stem 61 that is mounted in tubular section 37 and secured therein by suitable fasteners 63, and a second piece 65 having stem 67 secured within post 25 by fasteners 69. A bolt 71, about which rotation occurs, connects opposing interlockable heads 73 and 75, the head 73 featuring a circular portion 77 of radially extending wedges 79. The head 75 features a complementary circular portion of wedges 81 which can mate and interlock with the wedges 79 when the heads are brought together, as will be described, to secure one head against rotation relative to the other.

One end of the bolt 71 holds the head 75 by way of nut 83, and the other end is connected to a latch 85 by a pin 84 about which latch 85 can be pivoted, latch 85 having a cam portion 87 which slidably engages the outside surface of head 73. A conventional coil spring (not shown), mounts bolt 71 and urges head 75 away from head 73. FIG. 8 illustrates the open position for latch 85, in which position the heads are disengaged so that bar 25 can be freely rotated with respect to section 37. Latch 85 can be rotated to the lock position shown in FIG. 9, and the resulting camming action of portion 87 will draw the wedges 79 into locking engagement with wedges 81.

When it is desired to use assembly 11 as a sports goal, it is transported in its folded configuration to the play site, and then unfolded and deployed to the configuration shown in FIG. 1, with foot members 17 as well as side bars 25 both engaging the ground to give maximum stability to the assembly. The supplemental frame 19 is horizontal as shown, and a net 88 is attached over the assembly to provide a goal cavity suitable for many sports, as mentioned above.

After use, the assembly 11 is easily folded to the compact configuration of FIG. 2 by first rotating the frame 19 downwards to the vertical position shown, and then rotating the base frame 13 upwards through 90 degrees to the position shown, after appropriately manipulating the hinges 21.

The assembly 11, as well as a varient 91 of the invention shown in FIGS. 4 and 5, which varient does not employ a supplemental support such as frame 19, can also be used as a pitch back device. This is accomplished by manipulating the hinges 21*a* to hold the main frame 15*a* in an inclined position as FIG. 4 illustrates. FIG. 5 best shows how a conventional tensioned rebounding net 89 is mounted across the rectangular space bounded by top bar 31*a* and side posts 29*a*. FIG. 4 also illustrates an additional advantage of the foot members 17*a* in that when they are inclined as shown, the lower ends of side bars 29*a* are elevated above the ground. This ensures that the ground will not interfere with proper flexing of the lower part of the net 89*a*.

The assembly 91 can serve as a sports goal when the frame 15*a* is set upright, and a suitable goal net such as net 88 shown in FIG. 1, is attached over assembly 91.

It should be understood that the invention may be embodied in still other forms without departing from the true scope and breath of the invention as defined in the claims which follow.

What is claimed is:

1. A portable combination sports goal and pitch back assembly comprising:

a. a tubular U-shaped main frame having a horizontal top bar and two side posts with lower ends;

b. a pair of foot members, each one extending rearwardly from the lower end of a side post and at a right angle to said side post, and having a rear end;

c. a ground-engaging U-shaped tubular base frame that includes a rearward cross member and a pair of side members having front ends;

d. releaseably lockable hinge means for pivotably connecting the front ends of said base frame side members with the rear ends of said foot members, for rotation about transverse horizontal axes;

e. net means attachable to said main frame to form a goal cavity; and f. whereby said hinge means is adjustable to hold said foot members aligned horizontally with said base frame, and also adjustable to hold said main frame in an inclined position to the vertical.

2. An assembly as defined in claim 1 wherein said main frame top bar and side posts form a rectangular mouth, and including a rebound net mountable to said main frame and across said mouth.

3. An assembly as defined in claim 1 including a supplemental net support frame comprising a tubular U-shaped frame having a horizontal bar and a pair of side bars; and means for pivotally connecting ends of said side bars to said main frame top bar for adjustable rotation of said supplemental frame about said top bar.

4. An assembly as defined in claim 3 wherein said connecting means embraces said top bar with a static frictional force that is sufficient to hold said supplemental frame at an inclination to which it is rotated.

5. An assembly as defined in claim 4 wherein said connecting means comprises a tubular T-connector that includes a cylindrical inner surface that frictionally and slidably embraces said top bar.

6. An assembly as defined in claim 1 having a folded configuration in which said base frame is upwardly and forwardly inclined, with its rearward member adjacent said main frame.

7. An assembly as defined in claim 3 having a folded configuration in which said supplemental frame is vertically and downwardly disposed, and said base frame is upwardly and forwardly inclined with its rearward member adjacent said main frame.

8. An assembly as defined in claim 1 constructed of plastic.

9. An assembly as defined in claim 3 constructed of plastic.

* * * * *